US006499534B1

(12) United States Patent
Tawney et al.

(10) Patent No.: US 6,499,534 B1
(45) Date of Patent: Dec. 31, 2002

(54) HEAT EXCHANGER WITH TWO-STAGE HEAT TRANSFER

(75) Inventors: Jeffery Tawney, St. Petersburg; Eric Bright, Clearwater, both of FL (US)

(73) Assignee: AquaCal, St. Petersburg, FL (US)

( * ) Notice: Subject to any disclaimer, the term of this patent is extended or adjusted under 35 U.S.C. 154(b) by 0 days.

(21) Appl. No.: 10/078,022

(22) Filed: Feb. 15, 2002

(51) Int. Cl.[7] ..... F28D 7/12
(52) U.S. Cl. ..... 165/156
(58) Field of Search ..... 165/156, 155, 165/159, 163, DIG. 438

(56) References Cited

U.S. PATENT DOCUMENTS 3,696,636 A * 10/1972 Mille ..... 165/163
4,257,479 A * 3/1981 Newton ..... 165/156
4,829,778 A * 5/1989 Schlensker ..... 62/93
4,840,678 A * 6/1989 van der Schaaf ..... 127/2
4,907,418 A * 3/1990 Defazio ..... 165/159
5,046,548 A * 9/1991 Tilly ..... 165/156
5,487,423 A * 1/1996 Romero ..... 165/156
6,293,335 B1 9/2001 Tawney et al.

* cited by examiner

*Primary Examiner*—Henry Bennett
*Assistant Examiner*—Tho Van Duong
(74) *Attorney, Agent, or Firm*—Clifford A. Poff

(57) ABSTRACT

A tube and shell heat exchanger is formed by a shell enclosing an internal sidewall which in turn receives an internally located flow controller outer and inner heat exchange cavities are formed between the outer shell and the internal shell and the internal shell and the flow controller, respectively. Helical convolutions of the conduit are provided in each of the heat exchange cavities for counter concurrent flow of fluid medium from one cavity to another. A bottom wall closes off the outer shell.

10 Claims, 3 Drawing Sheets

HEAT EXCHANGER WITH TWO-STAGE HEAT TRANSFER

BACKGROUND OF THE INVENTION

1. Field of the Invention

The present invention relates to a heat exchanger for thermal conditioning of one fluid medium by heat transfer with a second fluid medium in a heat transfer tube and, more particularly, to a heat exchanger construction to provide inner and outer flow spaces for a two stage heat transfer with a fluid medium also passed consecutively along the flow spaces.

2. Description of the Prior Art

Evaporator and condenser functions provided by a heat exchanger are commonly used for diverse applications and while not so limited, the present invention is particularly useful in one common field of used where heat transfer with one medium consists of a flow of water for a swimming pool or spa. Swimming pool water is heated or cooled depending on the climate affecting the temperature of the pool water. The present invention is particularly applicable to a heat exchanger using a tube-in-shell construction. It is known to heat a flow of water for a swimming pool in an elongated tank having an internal chamber in which an electrically resistive heating element, frequently as a coil, is housed. Water is directed in a lengthwise path through the tank chamber containing the heating element for transfer of heat from the heating element to the water. In such a device, no control over the flow of water is provided within the internal chamber of the tank and because the heat exchanger incorporates an electrically resistive heating element as opposed to a fluid heat transfer medium, the application of such a heat exchanger is limited to use as a heater for water.

It is well known in the art to provide a heat exchanger to condition a flow of water in which a fluid is used as a heat transfer medium. In a type of construction known as "shell-and-tube" design, the heat transfer fluid is carried within a tube and the flow of water to be treated is directed past the tube, or tubes, within a shell housing. In the simplest arrangement, the heat exchanger consists of a tube within a tube and the fluids move either in the same direction, known as a "parallel flow" heat exchanger, or in opposite direction, known as a "counter flow" heat exchanger. In a tube within a tube construction, the outer shell provides the outer boundary to the water passageway along the shell which is the only control over the flow of water once it has entered the shell. The heat exchange coils spaced inwardly from the sidewall of the shell enhances turbulence, thus also assisting in the desired heat transfer. Typical designs allow a large percentage of water entering the shell to pass through without coming in contact with the heat exchange coils. Also the tube in shell design typically uses plastic for the shell material and glued to construction prevents easy of disassembly for servicing of the heat exchanger. Such a construction, although embodying a simple arrangement of parts, is costly as to fabrication. These disadvantages are also present in other shell-and-tube heat exchanges having a shell to house multiple tubes or a coiled tube.

In U.S. Pat. No. 6,293,335, there is disclosed a tube and shell heat exchanger having a transversely oriented inlet port and a spirally coiled heat transfer tube contained within an arcuate chamber created by an internal baffle in which the water to be conditioned travels along a helical pathway in which the flow has minimized water depth and high turbulence. This water flow management design imposed a large water pressure drop along the path of travel along the arcuate chamber containing the heat transfer tube. Compared to our earlier submission, already patented, which had a high-pressure drop on the waterside. The tube and shell heat exchanger maximizes heat transfer capability in a relatively easy to assemble design to make feasible the use of a higher cost material for the tubing such as titanium in a wide range of applications. The heat transfer tube is commonly formed from a metal such as copper or copper-nickel alloy to take advantage of favorable heat transfer properties and low cost of the metal material. Because of the favorable heat transfer properties with metals as copper and copper-nickel alloy, when heating an increased water flow is necessary the requirement is met by increasing the length of copper tubing in the coiled section thereby providing a greater residence time for the water flow in the heat exchanger. Where higher BTU heat transfer is needed for a given flow of water through the shell, providing a greater length of tubing to achieve the desired BTU heat transfer is conventional and cost effective rather than direct or otherwise manage the water flow to maximize heat transfer. Increasing the size of the heat exchanger to achieve the desired BTU heat transfer imposes a penalty of a disproportionate heat loss from the increase surface area of the housing needed to accommodate the additional length of tubing.

There are disadvantages associated with a copper heat transfer tube in a heat exchanger for water. One example of such disadvantages is in the thermal conditioning of salt water for applications such as holding tanks and aquariums for marine life. The marine life is susceptible to a toxic reaction to chemically produce products of corrosive reaction between the salt water and the copper metal of the heat transfer tube. The toxic reacting product can be eliminated by selecting a more chemically inert metal or alloy such as titanium to form the heat transfer tube in the heat exchanger. The use of titanium for the heat transfer tube of the heat exchanger offers the benefits of strength, durability and a prolonged service life as compared with copper for the heat transfer tube of a heat exchanger. However, to be economically competitive the high cost of titanium metals as compared with the cost of copper or copper-nickel alloy poses a need to maximize the heat transfer in a minimized heat transfer space and minimize thermal losses to the atmosphere.

Accordingly, it is an object of the present invention to provide a heat exchanger for conditioning a flow of a fluid medium within a shell along inner and outer heat exchange cavities each containing a helical conduct convolutions to maximize heat transfer between a fluid medium and heat transfer conduct.

It is another object of the present invention to provide complete control to the path of water flow through a coil in a tube in shell type heat exchanger to insure that all water flowing through the shell comes in contact or into such close proximity with the coil for enhanced heat transfer in the path of the water flow.

It is still a further object of the present invention to provide a heat exchanger for conditioning a flow of a fluid medium in which the flow of the fluid medium within a shell is reversed for between consecutive annular passageways one contained within the other and inner connected for continuous flow within a heat exchanger housing to minimize thermal losses to the atmosphere and to maximize heat transfer efficiency.

SUMMARY OF THE INVENTION

According to the present invention there is provided a heat exchanger to thermally condition a fluid medium, the heat exchanger including the combination of a shell having an outer shell sidewall spaced from an internal shell sidewall both closed in a fluid tight manner by a first end wall for defining an outer heat exchange cavity and an inner heat exchange cavity, a second end wall joined with the outer shell sidewall in a fluid tight manner and spaced from the internal shell sidewall to form a fluid pervious flow space interconnecting the outer heat exchange cavity and the inner heat exchange cavity, shell conduits forming an inlet port and an outlet port for conducting a flow of a first fluid medium along each of the outer heat exchange cavity and the inner heat exchange cavity, an elongated tubular conduit permeating the shell in a fluid tight manner and having a tubular conduit portion traversing the internal shell sidewall between outer helical conduit convolutions resident in the outer heat exchange cavity and inner helical conduit convolutions resident the inner heat exchange cavity for conducting a second fluid medium in a heat transfer relation with the first fluid medium, and a flow controller supported by the second end wall and having a media dispersing wall forming an inner boundary to the inner heat exchange cavity for directing a flow of the first fluid medium along the inner heat exchange cavity.

BRIEF DESCRIPTION OF THE DRAWINGS

The present invention will be more fully understood when the following description is read in light of the accompanying drawings in which.

DETAILED DESCRIPTION OF THE PREFERRED EMBODIMENT OF THE PRESENT INVENTION

Figure 2:
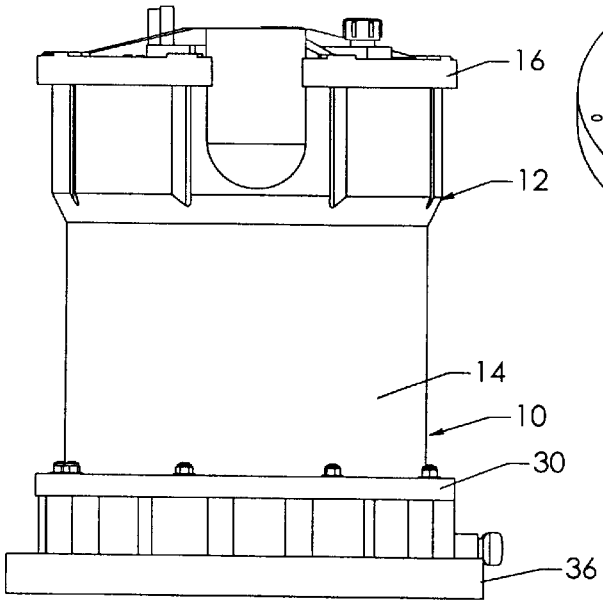
FIG. 2 is a side elevational view of the heat exchanger as shown in FIG. 1.
Figure 1:
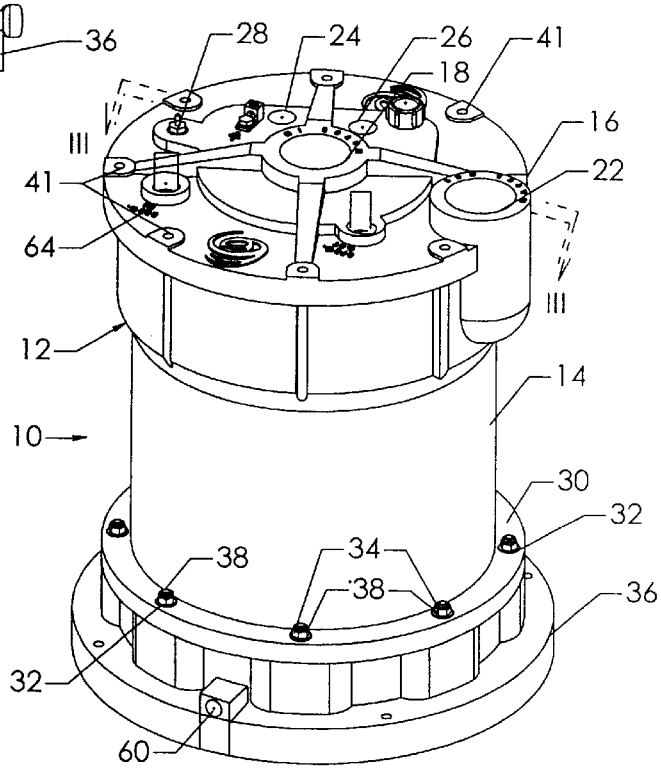
FIG. 1 is an isometric illustration of the heat exchanger according to the present invention.
Figure 3:
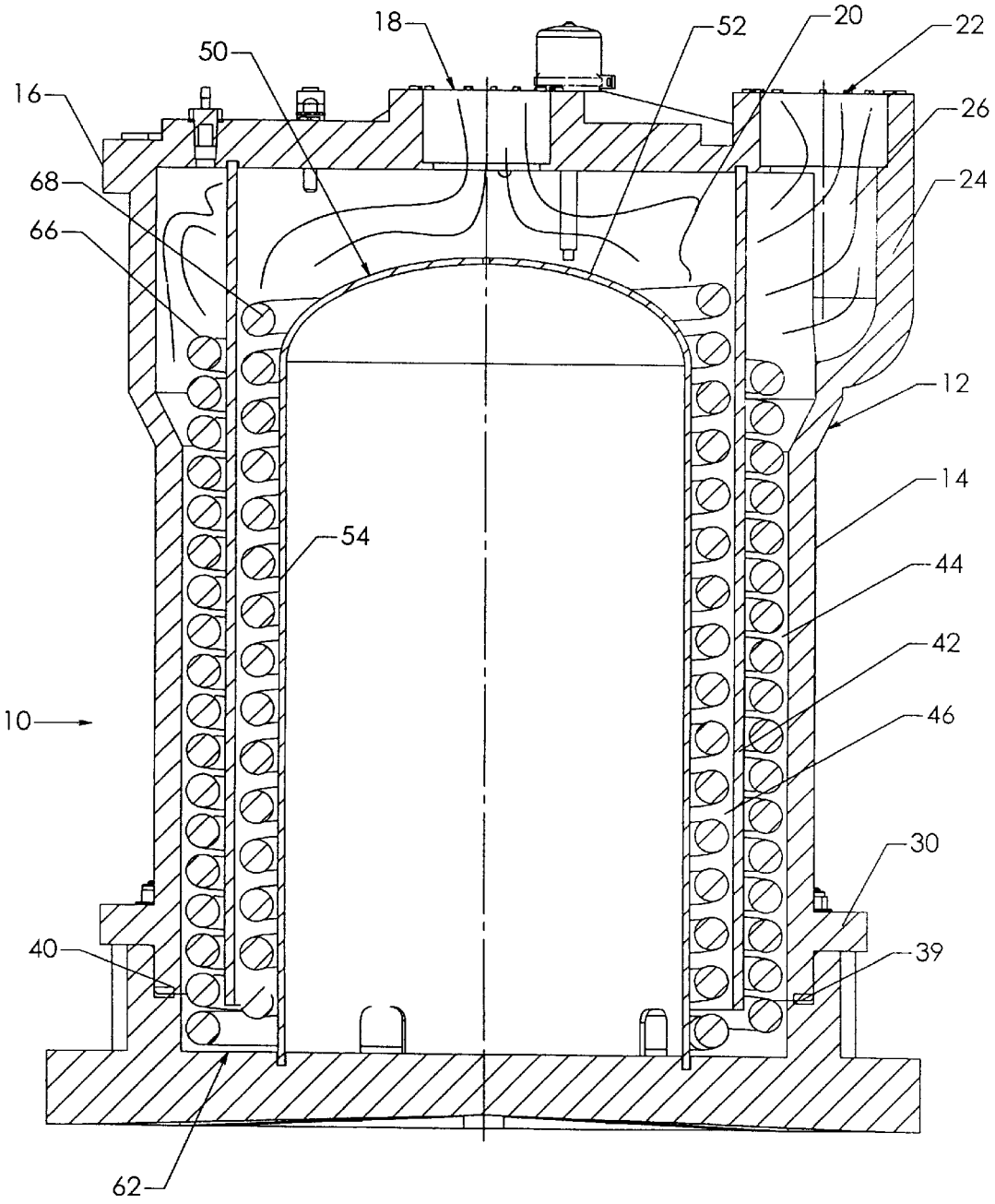
FIG. 3 is a section view taken along lines III—III of FIG. 2.
Figure 7:
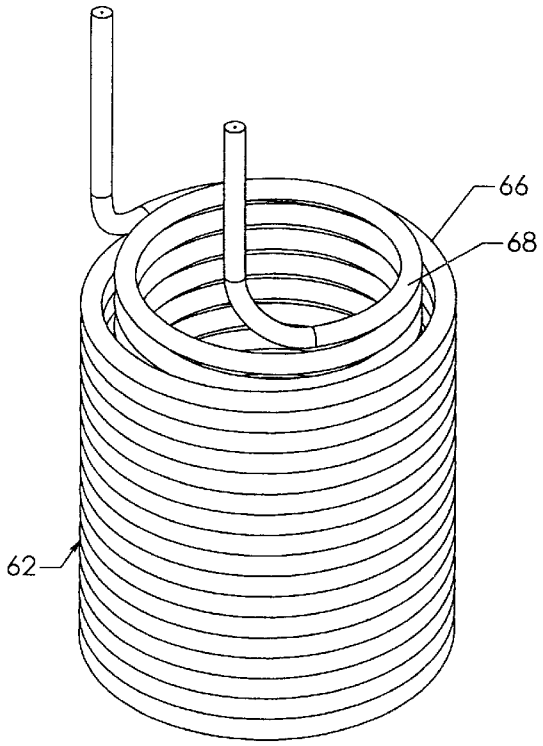
FIGS. 7 and 8 are isometric views taken along the topside and the bottom side, respectively, of concentric helical coils forming part of the heat exchanger shown in FIG. 1.
Figure 8:
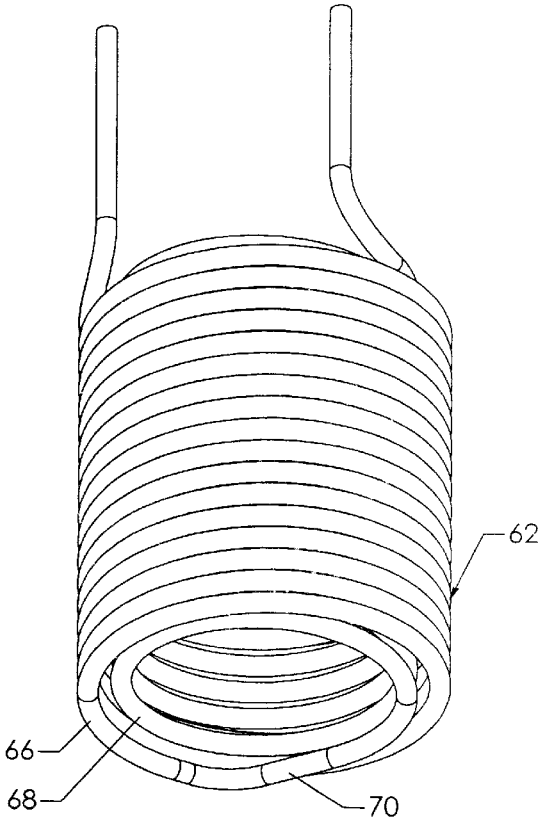

Referring to FIGS. 1–3, there is shown the preferred embodiment of a heat exchanger 10 embodying a construction and the arrangement of parts useful to form an evaporator unit or condenser unit for diverse applications including water heaters and water coolers particularly, for swimming pool water of swimming pools and spas. The heat exchanger includes an inverted bell jar shaped shell 12 defining a cylindrical outer shell sidewall 14 integral with an upper end wall 16 containing a centrally located fluid inlet port 18 through which a first fluid medium such as water is introduced into a supply header 20 (FIG. 3) of the heat exchanger. A fluid outlet port 22 is located radially outwardly in a shell sidewall enlargement 24 forming a discharge header 26 at the top of the shell from which the water exits the heat exchanger. The fluid inlet port 16 and fluid outlet port 22 contain threaded apertures for connection to piping forming part of the water flow circuit as a first fluid medium. The upper end wall 16 also contains angularly spaced apart access ports 24, 26 and 28 each provided with threads normally closed by a threaded plug or for receiving the internal threads of fittings used for mounting a thermal couple, a flow monitor and the like instruments to provide readouts of heater exchanger operating parameters at a remote monitoring site.

Figure 4:
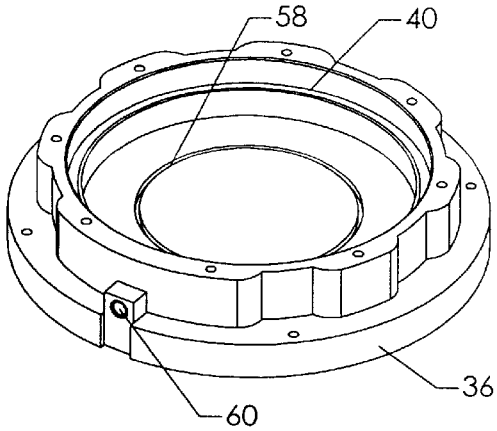
FIG. 4 is isometric view of a housing bottom forming part of the heat exchanger in FIG. 1.

The lower boundary to the shell 12 is formed with a radially extending flange 30 containing apertures 32 spaced about a bolt circle to receive stud members 34 extending from apertures formed in a bottom end wall 36 shown in detail in FIG. 4. The stud members 34 have threads to receive nut members 38 to which sufficient torque is applied to form a sealed, fluid-tight connection between the cylindrical outer shell sidewall 14 and the bottom end wall 36. For this purpose, as shown in FIG. 3, there is preferable provided a seal 39 between the lower terminal edge of sidewall 14 and an annular seat surface 40 formed in the bottom end wall 36. The upper end wall 16 of the shell 12 is preferably provided with apertures of 41 spaced about the same bolt circle as apertures 32 so that elongated stud members may extend from the apertures from the bottom end wall 36 along the entire shell sidewall 14 where threaded end portions of the studs are fitted with nut members for securing the shell 12 to the bottom end wall 36 is a fluid type manner.

Figure 5:
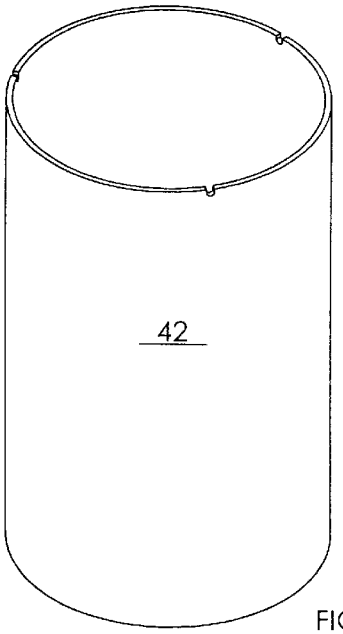
FIG. 5 is an isometric view of an inner shell sidewall forming part of the heat exchanger as shown in FIG. 1.

The volume enclosed by the shell 12 and the bottom wall 36 contains a cylindrically shaped internal shell sidewall 42, shown in detail in FIG. 5, supported at the upper end in a fluid type manner in an annular grove in the upper end wall 16 for defining an outer heat exchange cavity 44 as an elongated annulus between the cylindrical outer shell side wall 14 and in the internal shell sidewall 42. Inside the internal shell side wall 42 there is formed an inner heat exchange cavity 46 interconnected by a fluid pervious flow space 48 with the outer heat exchange cavity 44 formed by a gap separating the lower terminal edge of the internal sidewall 42 from the bottom end wall 36.

Figure 6:
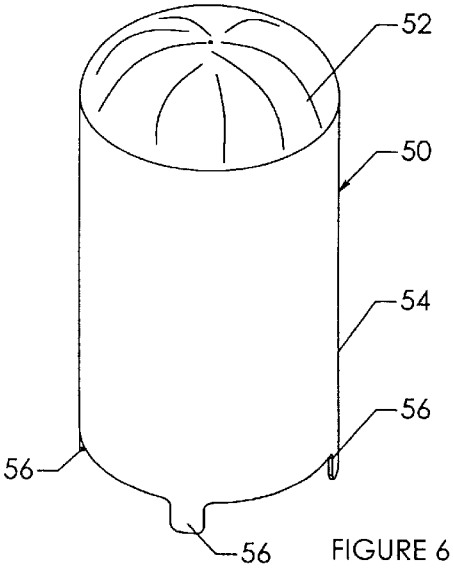
FIG. 6 is an isometric view of a flow controller forming part of the heat exchanger as shown in FIG. 1.

A flow controller 50, best shown in FIGS. 3 and 6, has the form of a bell jar with a hemispherical dome 52 forming a lower boundary to the supply header 20. A cylindrical sidewall 54 is spaced uniformly from the internal cylindrical surface of the internal sidewall 42 to define the inner heat exchange cavity 46 as an elongated annulus bounded by the internal sidewall 42 and the cylindrical sidewall 54. The flow controller is held in this position by arcuate support segments 56 secured in an annular grove 58 formed in the bottom end wall 36. Gaps separating adjacent ones of the support segments 56 allow a fluid flow communication with the interior of the flow controller 50. A drain line extends in the bottom end wall 36 between the area beneath the hemispherical dome of the flow controller 50 and the atmosphere by way of a port 60 in an external sidewall of the bottom end wall 36.

An elongated tubular conduit 62 has an inlet and an outlet permeating the upper end wall 16 of the shell 12 in a fluid tight manner by the use of suitable fittings 64. The tubular conduit 62 is made up of outer helical conduit convolutions 66 resident in the outer heat exchange cavity 44 and inner helical conduit convolutions 68 resident said inner heat exchange cavity 46 for conducting a second fluid medium in a heat transfer relation with the first fluid medium circulated through the cavities. The convolutions 66 and 68 are joined by a connector sleeve 70 which traversing the internal shell sidewall 42. The tubular conduit 62 conducts a heat transfer fluid such as a compressible heat transfer medium, for example nonflammable gases and liquid fluorinated hydrocarbons used as refrigerants (sold under the trademark Freon) or a sensible heat transfer medium such as water, through the heat exchanger.

The present invention prevents a large percentage of water entering the shell to pass through without coming in contact with the tubular conduit by the provision of the flow controller 50 which is preferably made of plastic and arranged so that the diameter of the hemispherical dome 52 and depending side wall 54 fills the space inside the inner helical conduit convolutions 68. This forces all water to flow over tubing in its path through the shell rather than passing through the space inside the helix. The internal side wall 42 takes the form of a sleeve that encapsulates the outer helical conduit convolutions 66 between the side wall 54 including the hemispherical dome 52 and the internal side wall 42 maintains long continued contact of the water with the tubular conduit 62 which also enhances turbulence thus assisting with the heat transfer process. The provision of the sleeve like construction of the internal sidewall 42 allows a configuration the tubular conduit 62 as a coil in a coil and maintains the controlled flow of water over each respective conduit convolutions.

Importantly, the internal shell sidewall 42 in the form of a sleeve also allows the maintaining of a counter flow configuration between the refrigerant flow and water flow within the coil in coil configuration. This counter flow design enhances heat transfer, which typically has been a design compromise in tube in shell design utilizing a coil in coil configuration.

This water flow management design also accomplishes a low-pressure drop through the coil on the waterside. The overall design configuration of the heat exchanger according to the present invention achieves high efficient performance over a wide range of flow rates. For comparison purposes, in a 100,000 Btuh, tube in tube coil design, the water flow requirements would be approximately 22 gpm. Typical tube in shell designs would require 40 plus gpm to achieve the same level of performance. The heat exchanger design of the present invention will match performance of the tube in tube at the same low flow rates as well as handle the higher flow rate which the tube in tube coils will not without excessive pressure drop. The bolt together design of the heat exchanger allows ease of disassembly for service or maintenance. Typical tube in shell design using plastic for the shell material are glued together preventing convenient disassembly. The provision of built in drain ports assures for freeze protection during severe winter months. Two drain ports are provided to facilitate vertical or horizontal installation of the heat exchanger. The shell design incorporates two bolt together patterns which allows the overall height to vary as required per Btuh rating without producing a dedicated shell size per capacity rating.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A heat exchanger to thermally condition a fluid medium, said heat exchanger including the combination of:

a shell having an outer shell sidewall spaced from an internal shell sidewall both closed in a fluid tight manner by a first end wall for defining an outer heat exchange cavity and an inner heat exchange cavity, a second end wall joined with said outer shell sidewall in a fluid tight manner and spaced from said internal shell sidewall to form a fluid pervious flow space interconnecting said outer heat exchange cavity and said inner heat exchange cavity;

shell conduits forming an inlet port and an outlet port for conducting a flow of a first fluid medium along each of said outer heat exchange cavity and said inner heat exchange cavity;

an elongated tubular conduit permeating said shell in a fluid tight manner and having a tubular conduit portion traversing said internal shell sidewall between outer helical conduit convolutions resident in said outer heat exchange cavity and inner helical conduit convolutions resident said inner heat exchange cavity for conducting a second fluid medium in a heat transfer relation with said first fluid medium; and a flow controller supported by said second end wall and having a media dispersing wall forming an inner boundary to said inner heat exchange cavity for directing a flow of said first fluid medium along said inner heat exchange cavity.

2. The heat exchanger according to claim 1 wherein said outer shell sidewall and said inner shell sidewall are tubular and concentric with an annulus there between defining said outer heat exchange cavity.

3. The heat exchanger according to claim 2 wherein said outer shell sidewall includes an enlarged diameter side wall portion at said first end wall for forming a media manifold communicating with said outlet port.

4. The heat exchanger according to claim 1 wherein said controller wall includes a hemispherical dome on said side wall of said flow controller communicating with said inlet port forming a medial manifold for said first fluid medium.

5. The heat exchanger according to claim 1 wherein said outer side wall includes a radial flange containing apertures spaced about a bolt circle, and wherein said heat exchanger further includes threaded fasteners engaged with said flange for forming a sealed fluid-tight connection with said second end wall.

6. The heat exchanger according to claim 1 wherein said inner said sidewall is anchored in an annular groove in said first end wall.

7. The heat exchanger according to claim 1 wherein said first end wall is integral with to said outer sidewall.

8. The heat exchanger according to claim 1 further including flow controller supports extending from a terminal edge of the side wall of said flow controller for providing a fluid media flow space between said controller side wall and said second end wall.

9. The heat exchanger according to claim 8 wherein said flow controller support segments are anchored in an annular groove in said second end wall.

10. The heat exchanger according to claim 1 further including a drain line in said second end wall communicating with said inner heat exchange cavity and atmosphere.

* * * * *

UNITED STATES PATENT AND TRADEMARK OFFICE
Certificate

Patent No. 6,499,534 B1 Patented: December 31, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Jeffery Tawney, St. Petersburg, FL (US); Eric Bright, Clearwater, FL (US); and Michael B. Gilmore, Tampa, FL (US).

Signed and Sealed this Third Day of March 2009.

FRANTZ F. JULES
*Supervisory Patent Examiner*
Art Unit 3744